US007065224B2

(12) United States Patent
Cornelius et al.

(10) Patent No.: US 7,065,224 B2
(45) Date of Patent: Jun. 20, 2006

(54) MICROPHONE FOR A HEARING AID OR LISTENING DEVICE WITH IMPROVED INTERNAL DAMPING AND FOREIGN MATERIAL PROTECTION

(75) Inventors: Elrick Lennaert Cornelius, Haarlem (NL); Paul Leonardus Clemens, Amsterdam (NL); Paul C. van Hal, Hoorn (NL); Mike Geskus, Purmerend (NL)

(73) Assignee: Sonionmicrotronic Nederland B.V., Amsterdam (NL)

( * ) Notice: Subject to any disclaimer, the term of this patent is extended or adjusted under 35 U.S.C. 154(b) by 301 days.

(21) Appl. No.: 09/966,176

(22) Filed: Sep. 28, 2001

(65) Prior Publication Data

US 2003/0063768 A1 Apr. 3, 2003

(51) Int. Cl.
*H04R 21/02* (2006.01)

(52) U.S. Cl. ..... 381/369; 181/158

(58) Field of Classification Search ..... 381/364, 381/150, 361, 355, 356, 191, 322, 91, 396; 181/158, 157, 148; 29/594, 592
See application file for complete search history.

(56) References Cited

U.S. PATENT DOCUMENTS

| | | | | |
|---|---|---|---|---|
| 2,143,097 | A | 1/1939 | Warnke | 179/119 |
| 2,260,727 | A | 10/1941 | Sears et al. | |
| 2,425,481 | A | 8/1947 | Morse | |
| 2,794,862 | A | 6/1957 | Tøpholm | 179/114 |
| 2,912,523 | A | 11/1959 | Knowles et al. | 179/108 |
| 2,994,016 | A | 7/1961 | Tibbetts et al. | 317/172 |
| 2,998,804 | A | 9/1961 | Clement | 121/41 |
| 3,002,058 | A | 9/1961 | Knowles | 179/114 |
| 3,013,127 | A | 12/1961 | Christensen et al. | 179/114 |
| 3,154,172 | A | 10/1964 | Tibbetts | 181/32 |
| 3,163,723 | A | 12/1964 | Tibbetts | 179/180 |
| 3,177,412 | A | 4/1965 | Carlson | 317/173 |
| 3,193,048 | A | 7/1965 | Kohler | 181/31 |
| 3,249,702 | A | 5/1966 | Carlson | 179/115 |
| 3,251,954 | A | 5/1966 | Carlson | 179/115 |
| 3,413,424 | A | 11/1968 | Carlson | 179/115 |
| 3,436,492 | A | 4/1969 | Reedyk | |
| 3,491,436 | A | 1/1970 | Carlson | 29/594 |

(Continued)

FOREIGN PATENT DOCUMENTS

| | | |
|---|---|---|
| DE | 2119912 | 3/1974 |
| EP | 0 147 373 | 11/1984 |

(Continued)

*Primary Examiner*—Vivian Chen
*Assistant Examiner*—Lun-See Lao
(74) *Attorney, Agent, or Firm*—Jenkens & Gilchrist

(57) ABSTRACT

A microphone and method for dampening the frequency response of the microphone by disposing a dampening frame in a rear volume of the microphone. The microphone generally includes a housing, a diaphragm, a damping frame, and a backplate. The diaphragm rests on embossments in the housing, and a damping frame including a damping slit cut into an inner edge of the damping frame is positioned against the diaphragm. The backplate is positioned adjacent the damping frame to define an aperture which allows air to escape from the area between the backplate and the diaphragm into the rear volume of the microphone, thus dampening the frequency response of the microphone. The method includes the steps of aligning a sheet of diaphragms with a sheet of damping frames, curing these two sheets to form a carrier sheet having a plurality of subassemblies, singulating each subassembly, installing a backplate onto each subassembly to form a cartridge, and placing the cartridge into a microphone housing.

31 Claims, 9 Drawing Sheets

U.S. PATENT DOCUMENTS

| | | | | | |
|---|---|---|---|---|---|
| 3,531,745 | A | | 9/1970 | Tibbetts | 335/231 |
| 3,536,861 | A | | 10/1970 | Dunlavy | 179/107 |
| 3,560,667 | A | | 2/1971 | Carlson | 179/114 |
| 3,573,397 | A | | 4/1971 | Sawyer et al. | 179/115 |
| 3,577,020 | A | | 5/1971 | Carlson | 310/8.2 |
| 3,588,382 | A | | 6/1971 | Reedyk | |
| 3,588,383 | A | | 6/1971 | Carlson et al. | 179/19 A |
| 3,617,653 | A | | 11/1971 | Tibbetts | 179/114 |
| 3,671,684 | A | | 6/1972 | Tibbetts | 179/117 |
| 3,701,865 | A | | 10/1972 | Carlson | 179/181 |
| 3,742,156 | A | | 6/1973 | Broersma | 179/119 A |
| 3,722,133 | A | | 11/1973 | Schmitt | |
| 3,935,398 | A | | 1/1976 | Carlson et al. | 179/114 A |
| 3,743,304 | A | | 3/1976 | Piribauer | |
| 3,944,756 | A | | 3/1976 | Lininger | |
| 2,963,881 | A | * | 6/1976 | Fraim et al. | 381/357 |
| 3,963,881 | A | | 6/1976 | Fraim et al. | |
| 4,014,091 | A | | 3/1977 | Kodera et al. | |
| 4,063,050 | A | | 12/1977 | Carlson | 179/111 |
| 4,109,116 | A | | 8/1978 | Victoreen | 179/107 E |
| 4,117,275 | A | | 9/1978 | Miyanaga et al. | 179/111 |
| 4,160,881 | A | | 7/1979 | Smulders | |
| 4,189,627 | A | | 2/1980 | Flanagan | 179/180 |
| 4,234,811 | A | | 11/1980 | Hishida et al. | |
| 4,236,051 | A | | 11/1980 | Nakagawa et al. | 179/111 |
| 4,249,043 | A | | 2/1981 | Morgan et al. | |
| 4,268,725 | A | * | 5/1981 | Nakagawa et al. | 381/174 |
| 4,272,654 | A | | 6/1981 | Carlson | 179/119 A |
| 4,302,634 | A | | 11/1981 | Paglia | |
| 4,310,906 | A | | 1/1982 | Cantrell, Jr. et al. | |
| 4,321,432 | A | | 3/1982 | Matsutani et al. | |
| 4,331,840 | A | | 5/1982 | Murphy et al. | |
| 4,410,769 | A | | 10/1983 | Tibbetts | 179/119 A |
| 4,418,246 | A | | 11/1983 | Sawyer | |
| 4,429,193 | A | | 1/1984 | Busch-Vishniac et al. | |
| 4,442,324 | A | | 4/1984 | Blanchard et al. | |
| 4,447,678 | A | | 5/1984 | Fidi | |
| 4,450,930 | A | | 5/1984 | Killion | 181/158 |
| 4,456,796 | A | | 6/1984 | Nakagawa et al. | |
| 4,509,193 | A | | 4/1985 | Carlson | 381/113 |
| 4,513,348 | A | | 4/1985 | Grantham | |
| 4,516,428 | A | | 5/1985 | Konomi | |
| 4,533,795 | A | | 8/1985 | Baumhauer, Jr. et al. | |
| 4,539,441 | A | | 9/1985 | Eggert et al. | |
| 4,542,264 | A | | 9/1985 | Schmidt et al. | |
| 4,558,184 | A | | 12/1985 | Busch-Vishniac et al. | |
| 4,567,382 | A | | 1/1986 | van Halteren | |
| 4,607,145 | A | | 8/1986 | Ravinet et al. | |
| 4,607,383 | A | | 8/1986 | Ingalls | |
| 4,621,171 | A | | 11/1986 | Wada et al. | |
| 4,685,137 | A | | 8/1987 | Watson et al. | |
| 4,691,363 | A | | 9/1987 | Khanna | |
| 4,697,334 | A | | 10/1987 | Madsen et al. | |
| 4,701,640 | A | | 10/1987 | Flygstad et al. | |
| 4,728,934 | A | | 3/1988 | Pfänder et al. | 340/407 |
| 4,730,283 | A | | 3/1988 | Carlson et al. | |
| 4,764,690 | A | | 8/1988 | Murphy | 307/400 |
| 4,777,650 | A | | 10/1988 | Frederiksen | |
| 4,790,021 | A | | 12/1988 | Pribyl | |
| 4,796,288 | A | | 1/1989 | Busche et al. | |
| 4,800,982 | A | | 1/1989 | Carlson | 181/130 |
| 4,807,612 | A | | 2/1989 | Carlson | 128/868 |
| 4,815,138 | A | | 3/1989 | Diethelm | 381/69.2 |
| 4,817,164 | A | | 3/1989 | Bertignoll et al. | |
| 4,837,833 | A | * | 6/1989 | Madaffari | 381/322 |
| 4,845,512 | A | | 7/1989 | Arway | |
| 4,867,267 | A | | 9/1989 | Carlson | 181/130 |
| 4,870,688 | A | | 9/1989 | Voroba et al. | 381/60 |
| 4,872,148 | A | | 10/1989 | Kirby et al. | |
| 4,891,843 | A | | 1/1990 | Paulus, Jr. et al. | |
| 4,910,840 | A | | 3/1990 | Sprenkels et al. | |
| 4,922,471 | A | | 5/1990 | Kuehnel | |
| 4,956,868 | A | | 9/1990 | Carlson | 381/189 |
| 4,977,590 | A | | 12/1990 | Milovancevic | |
| 4,993,072 | A | | 2/1991 | Murphy | |
| 5,014,322 | A | | 5/1991 | Yasuda et al. | |
| 5,068,901 | A | | 11/1991 | Carlson | 381/68.6 |
| 5,101,435 | A | | 3/1992 | Carlson | 381/68.6 |
| 5,101,543 | A | | 4/1992 | Cote et al. | |
| 5,101,544 | A | * | 4/1992 | Kubik | 492/7 |
| 5,255,246 | A | * | 10/1993 | van Halteren | 367/170 |
| 5,319,717 | A | | 6/1994 | Holesha | 381/168 |
| 5,335,210 | A | | 8/1994 | Bernstein | |
| 5,335,286 | A | | 8/1994 | Carlson et al. | 381/191 |
| 5,388,163 | A | | 2/1995 | Elko et al. | |
| 5,401,914 | A | | 3/1995 | Curran et al. | |
| 5,408,534 | A | | 4/1995 | Lenzini et al. | |
| 5,410,608 | A | | 4/1995 | Lucey et al. | |
| 5,446,413 | A | | 8/1995 | Loeppert et al. | |
| 5,452,268 | A | | 9/1995 | Bernstein | |
| 5,490,220 | A | | 2/1996 | Loeppert | |
| 5,522,123 | A | | 6/1996 | Kugo | |
| 5,548,658 | A | | 8/1996 | Ring et al. | |
| 5,570,428 | A | | 10/1996 | Madaffari et al. | |
| 5,589,799 | A | | 12/1996 | Madaffari et al. | 330/277 |
| 5,615,273 | A | | 3/1997 | Lucey et al. | |
| 5,619,476 | A | | 4/1997 | Haller et al. | |
| 5,673,330 | A | | 9/1997 | Chang | |
| 5,677,965 | A | | 10/1997 | Moret et al. | |
| 5,682,075 | A | | 10/1997 | Bolleman et al. | |
| 5,708,721 | A | | 1/1998 | Salvage et al. | |
| 5,796,848 | A | | 8/1998 | Martin | 381/68.2 |
| 5,809,155 | A | | 9/1998 | Su | |
| 5,861,779 | A | | 1/1999 | Loeppert et al. | |
| 5,862,239 | A | | 1/1999 | Kubli et al. | |
| 5,870,351 | A | | 2/1999 | Ladabaum et al. | |
| 5,875,251 | A | | 2/1999 | Sun | |
| 5,881,158 | A | | 3/1999 | Lesinski et al. | |
| 5,889,872 | A | | 3/1999 | Sooriakumar et al. | |
| 5,894,452 | A | | 4/1999 | Ladabaum et al. | |
| 5,946,403 | A | | 8/1999 | Josephson et al. | |
| 5,949,895 | A | | 9/1999 | Ball et al. | |
| 5,952,645 | A | | 9/1999 | Wang et al. | |
| 5,970,159 | A | | 10/1999 | McIntosh | |
| D416,912 | S | | 11/1999 | Hsieh | |
| 5,978,491 | A | | 11/1999 | Papadopoulos | |
| 5,982,709 | A | | 11/1999 | Ladabaum et al. | |
| 5,982,905 | A | | 11/1999 | Grodinsky et al. | |
| 5,990,454 | A | | 11/1999 | Westerberg et al. | |
| 6,011,855 | A | | 1/2000 | Selfridge et al. | |
| 6,031,922 | A | | 2/2000 | Tibbetts | |
| 6,044,160 | A | | 3/2000 | Norris | |
| 6,078,677 | A | | 6/2000 | Dolleman et al. | 381/418 |
| 6,084,972 | A | * | 7/2000 | van Halteren et al. | 381/92 |
| 6,169,810 | B1 | * | 1/2001 | van Halteren et al. | 381/174 |
| 6,178,249 | B1 | | 1/2001 | Hietanen et al. | |
| 6,201,876 | B1 | | 3/2001 | Niemi et al. | |
| 6,243,474 | B1 | | 6/2001 | Tai et al. | |
| 6,323,049 | B1 | | 11/2001 | Lee | |
| 6,366,678 | B1 | | 4/2002 | Madaffari et al. | |
| 6,438,243 | B1 | | 8/2002 | Ikeuchi et al. | |
| 6,504,937 | B1 | | 1/2003 | Papadopoulos et al. | |
| 6,532,293 | B1 | | 3/2003 | Collins | |
| 6,549,632 | B1 | | 4/2003 | Akino et al. | |
| 6,580,797 | B1 | | 6/2003 | Papadopoulos et al. | |
| 6,594,369 | B1 | | 7/2003 | Une | |
| 6,597,793 | B1 | | 7/2003 | Darbut et al. | |
| 6,606,389 | B1 | | 8/2003 | Selfridge, deceased et al. | |
| 6,614,911 | B1 | | 9/2003 | Bryson et al. | |
| 6,647,368 | B1 | | 11/2003 | Nemirovski | |
| 6,671,379 | B1 | | 12/2003 | Nemirovski | |

| | | | |
|---|---|---|---|
| 6,677,176 | B1 | 1/2004 | Wong et al. |
| 6,684,484 | B1 | 2/2004 | Collins |
| 6,694,032 | B1 | 2/2004 | Park et al. |
| 6,707,920 | B1 | 3/2004 | Miller |
| 2002/0076076 | A1 | 1/2002 | Kay et al. |
| 2003/0021423 | A1 | 1/2003 | Sheeper et al. |
| 2003/0063768 | A1 | 4/2003 | Cornelius et al. |

FOREIGN PATENT DOCUMENTS

| | | | |
|---|---|---|---|
| EP | 0 194 958 | | 9/1986 |
| EP | 0 326 040 | | 8/1989 |
| EP | 0 371 620 | | 6/1990 |
| EP | 0 533 284 | A1 | 3/1993 |
| EP | 0 499 237 | | 5/1995 |
| EP | 0 561 566 | | 9/1995 |
| EP | 0 670 602 | | 9/1995 |
| EP | 0 664 942 | | 2/1997 |
| EP | 0 800 331 | A2 | 10/1997 |
| EP | 0 802 700 | A1 | 10/1997 |
| EP | 0 969 695 | | 1/2000 |
| EP | 1 067 819 | | 7/2000 |
| EP | 1 052 880 | | 11/2000 |
| EP | 1 100 289 | | 11/2000 |
| JP | 59-105800 | | 6/1984 |
| JP | 60-074800 | | 4/1985 |
| JP | 60-146015 | | 1/1987 |
| JP | 10-136492 | | 5/1998 |
| NL | 6602799 | | 3/1966 |
| WO | WO 84/00662 | | 2/1984 |
| WO | WO 8401683 | | 4/1984 |
| WO | WO 88/02208 | | 3/1988 |
| WO | 95/22879 | | 8/1995 |
| WO | WO 98/35530 | | 8/1998 |
| WO | 01/26413 | A2 | 4/2001 |
| WO | WO 01/63970 | | 8/2001 |
| WO | 01/63970 | | 8/2001 |
| WO | 01/63970 | A2 | 8/2001 |
| WO | WO 01/89264 | A1 | 11/2001 |

* cited by examiner

MICROPHONE FOR A HEARING AID OR LISTENING DEVICE WITH IMPROVED INTERNAL DAMPING AND FOREIGN MATERIAL PROTECTION

FIELD OF THE INVENTION

The present invention relates generally to electroacoustic transducers, and in particular, to a microphone or listening device having a dampened peak frequency response.

BACKGROUND OF THE INVENTION

Miniature microphones, such as those used in hearing aids, convert acoustical sound waves into an audio signal which is processed (e.g., amplified) and sent to a receiver of the hearing aid. The receiver then converts the processed signal to acoustical sound waves that is broadcast towards the eardrum. A microphone generally a moveable diaphragm and a charged backplate for converting the sound waves into an audio signal. The diaphragm divides the inner volume of the microphone into a front volume and a rear volume. Sound waves enter the front volume of the microphone via a sound inlet.

For certain applications, it is desirable to dampen the peak frequency response of the microphone by increasing the inertance presented to the sound entering the microphone. Inertance may be increased by placing an obstruction near the sound inlet in the front volume of the microphone. The obstruction may be a damping screen made of a grid-like mesh material placed over the sound inlet or a shaped embossment or structure formed or placed inside the housing of the microphone near the sound inlet. However, the damping screen can become clogged as debris and foreign material accumulate on its surface. As the damping screen becomes increasingly clogged, the microphone's frequency response is altered from the desired specification. Similarly, the shaped structure depends on its shape to create the desired damping effect, so as debris accumulates around the shaped structure, thereby altering its shape, the microphone's frequency response is altered from specifications. In both cases, the accumulation of debris, such as dust, hairspray, pollen, and other particles adversely affects the peak frequency response of the microphone, and in some cases, causes microphone malfunction.

Unlike the front volume, the rear volume is typically sealed off from the front volume, creating an area within the microphone that is largely impervious to debris. If the damping mechanism were incorporated into the rear volume, the adverse effects of debris and other foreign matter could be significantly reduced. Therefore, what is needed is a microphone that achieves dampening of the peak frequency response by disposing a damping mechanism in the rear volume of the microphone instead of in the front volume.

SUMMARY OF THE INVENTION

The present invention is a microphone having a housing, a diaphragm, a damping frame, and a backplate. The diaphragm is disposed in the housing and divides the inner cavity of the housing into a front volume and a rear volume. A damping frame is positioned against the diaphragm and includes a damping slit which is formed along at least one inner edge of the damping frame. In one embodiment, the backplate is positioned within the damping frame and includes standoffs to position the backplate at a known distance from the diaphragm. The damping slit of the damping frame defines an aperture through which air may escape from the area between the diaphragm and the backplate to the rear volume of the microphone, thus dampening the peak frequency response.

In another embodiment, the backplate is positioned against the damping frame such that its thickness defines the distance between the backplate and the diaphragm. The damping frame includes at least one damping slit formed along at least one inner edge of the damping frame. The positioning of the backplate against the damping frame defines an aperture through which air may escape from the area between the diaphragm and the backplate to the rear volume of the microphone.

The backplate is electrically coupled to an electronic circuit, which processes the electrical signal transduced by the microphone. The aperture defined by the damping frame and the backplate causes the peak frequency response of the microphone to be dampened.

The present invention also contemplates a method of producing a cartridge for use in a microphone. A first production sheet containing a plurality of damping frames includes a plurality of registration holes. A second production sheet containing a plurality of diaphragms also includes a plurality of registration holes. A layer of adhesive is disposed on the surface of the first production sheet, and the first production sheet is urged toward the second production sheet to form a carrier sheet. The first and second production sheets are aligned via their respective registration holes. The carrier sheet is heated until cured, and a plurality of subassemblies are singulated from the carrier sheet to form individual subassemblies, each subassembly including a diaphragm secured to a damping frame. A backplate is installed onto each subassembly to form a cartridge. The placement of the backplate onto the subassembly forms an aperture between the backplate and damping frame of the subassembly. The assembled cartridge is placed into a housing, and the remaining microphone components are assembled.

The above summary of the present invention is not intended to represent each embodiment, or every aspect, of the present invention. This is the purpose of the figures and the detailed description which follow.

BRIEF DESCRIPTION OF THE DRAWINGS

The foregoing and other advantages of the invention will become apparent upon reading the following detailed description and upon reference to the drawings.

Figure 1:
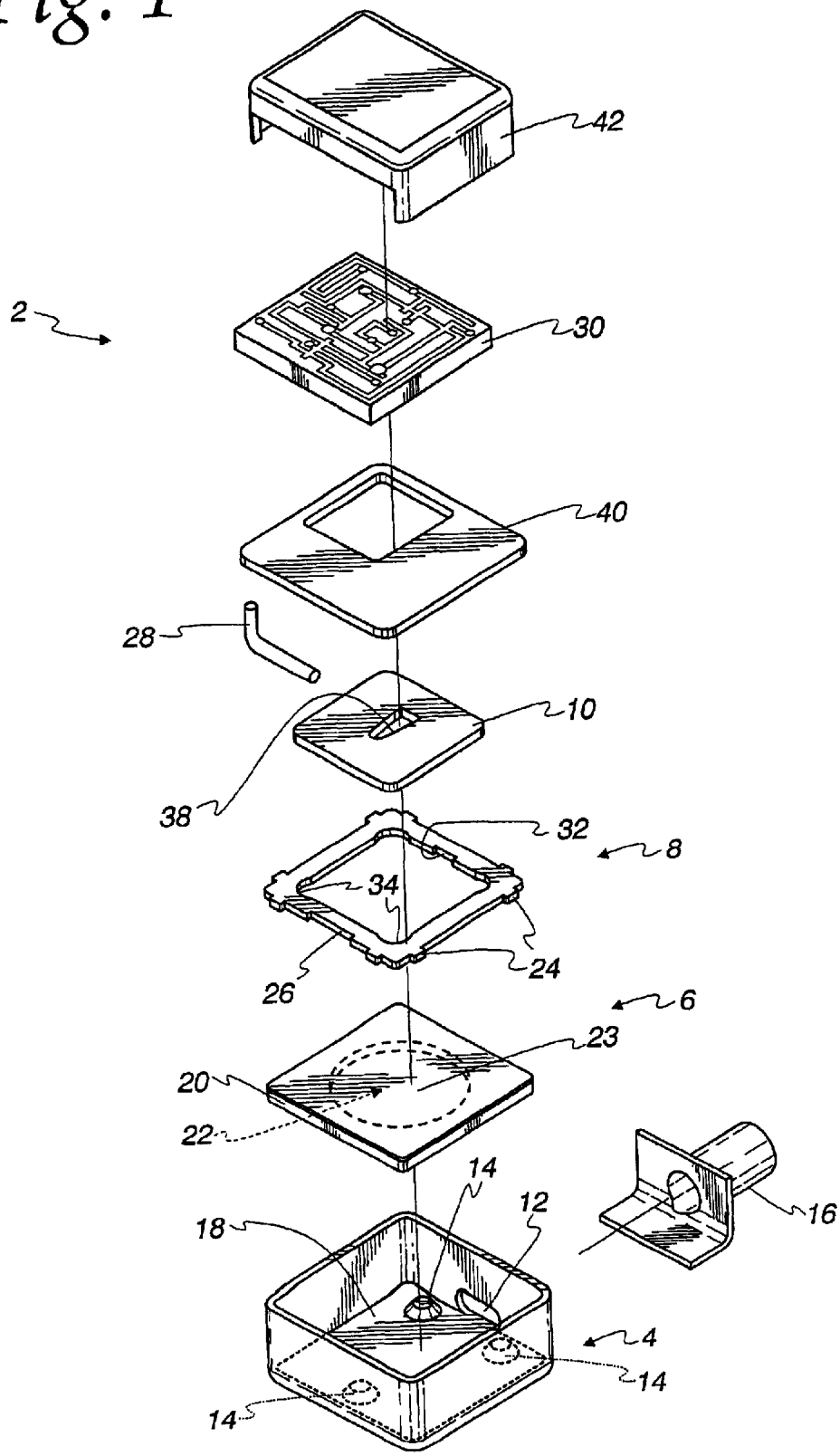
FIG. 1 is an exploded isometric view of a microphone according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 2:
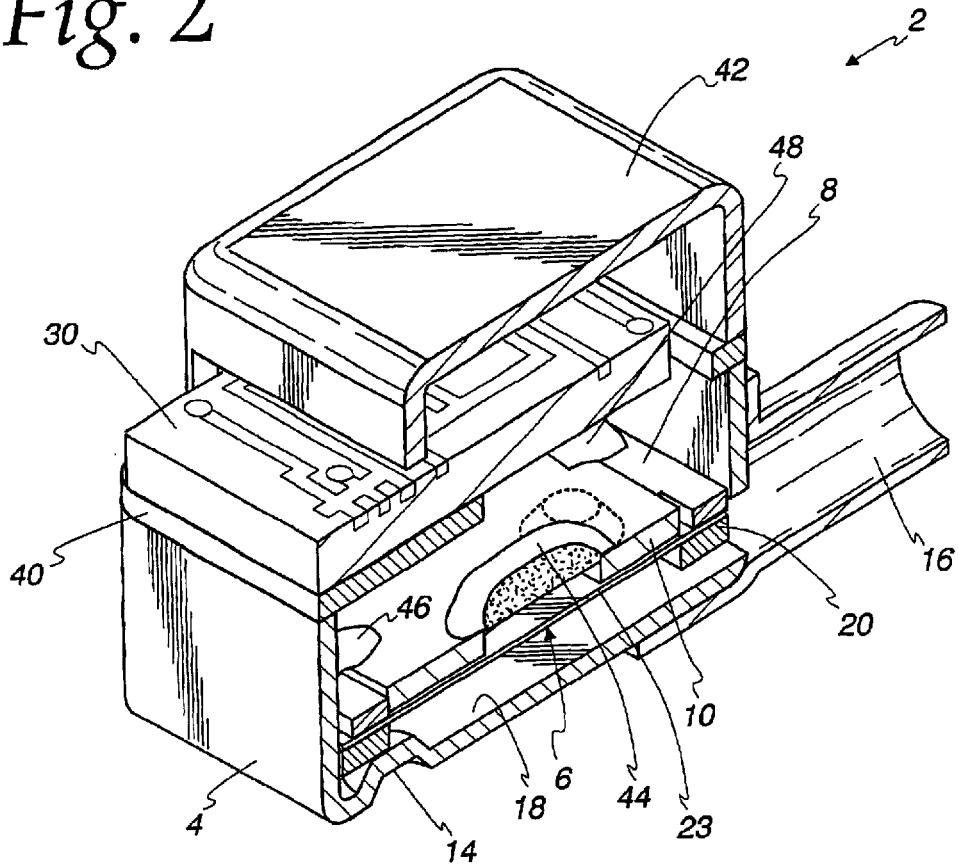
FIG. 2 is a cross-sectional isometric view of the microphone illustrated in FIG. 1.
Figure 3:
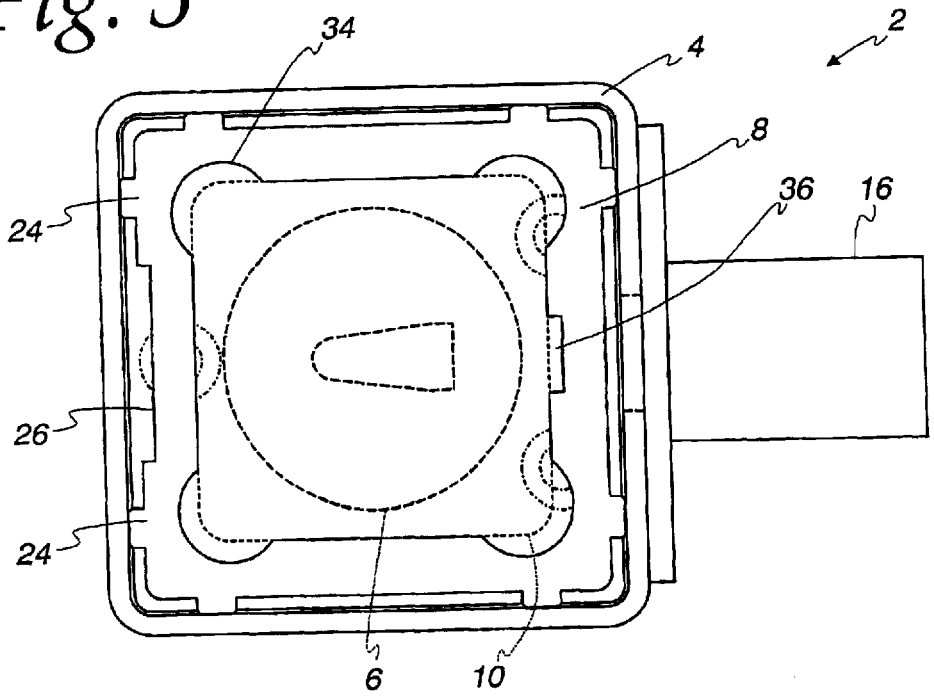
FIG. 3 is a top view that illustrates the inter-relationship of the cartridge of the microphone illustrated in FIG. 1.

FIGS. 1, 2, and 3 illustrate several views of a microphone 2 that generally includes a housing 4, a diaphragm 6, a damping frame 8, and a backplate 10. The housing 4 includes a sound inlet 12 and a set of internal embossments 14. The sound inlet 12 receives acoustical sound waves via a sound inlet tube 16. The microphone 2 includes three embossments 14, but in alternate embodiments, fewer or more embossments 14 may be employed. The embossment 14 is formed by inwardly deforming a portion of a floor 18 of the housing 4. In another embodiment, the embossment 14 is not formed from the floor 18 of the housing 4, but is rather a separate support member that is secured to the floor 18 of the housing 4. The housing 4 may be made of metal, such as steel or aluminum, or metallized non-conductive materials, such as metal particle-coated plastics.

The diaphragm 6 includes a frame 20 having a shaped opening 22 and a membrane 23 disposed across the upper surface of the frame 20. The frame 20 of the diaphragm 6 is disposed on the embossments 14 and creates a front volume between the lower surface of the diaphragm 6 and the floor 18 of the housing 4 and a rear volume defined above the upper surface of the diaphragm 6. The frame 20 of the diaphragm 6 is made of metal, such as a zinc/copper alloy, and the membrane 23 is made of mylar evaporated with gold. In alternate embodiments, the membrane 23 may be made of another semi-flexible material evaporated with any suitable electrically conducting material. The membrane 23 may also include a tiny pressure vent to equalize static pressures in the front and rear volumes.

Although the diaphragm 6 is shown positioned against the embossments 14 of the housing 4, in an alternate embodiment, the housing 4 does not include the embossments 14 and the lower surface of the diaphragm 6 includes standoffs (not shown). In another embodiment, the housing 4 does not include the embossments 14, and the diaphragm rests on the floor 18 of the microphone 2 with the membrane 23 a short distance above the floor 18.

The shaped opening 22 of the diaphragm 6 is shown in FIG. 1 as having a generally circular shape. In alternate embodiments, the shaped opening 22 may have a generally square or polygonal shape or any other geometric shape.

As can be seen from FIG. 1, the front volume of the housing 4 lacks an additional damping mechanism for increasing the inertance of the sound presented to the microphone 2. Acoustical sound waves pass through the sound inlet tube 16 and enter into the sound inlet 12 (which creates some increased inertance) of the housing 4 and engage the membrane of the diaphragm 6 without encountering such a damping mechanism. In an alternate embodiment, the microphone 2 includes a damping mechanism in the front volume, such as a mesh, and a damping mechanism in the rear volume, such as the damping frame 8, the damping function of which is described below.

The damping frame 8 is positioned against the diaphragm 6, and is secured to the frame 20 of the diaphragm 6 by adhesive or other bonding techniques, such as those described below with respect to FIGS. 10–14. The damping frame 8 includes a plurality of registration clamping members 24 formed along the outer periphery of the damping frame 8. The registration clamping members 24 of the damping frame 8 engage the inner walls of the housing 4 when the damping frame 8 is disposed inside the housing 4. In FIG. 1, two registration clamping members 24 are shown on each side of the damping frame 8, but in alternate embodiments, fewer or more registration clamping members 24 may be formed along the periphery of the damping frame 8. The registration clamping members 24 permit self-centering of the damping frame 8 into the housing 4 and allow the damping frame 8 to be "clamped" in place or securely seated inside the housing 4. The damping frame 8 does not need to include the registration clamping members 24 to achieve the enhanced results of the present invention, but the registration clamping members 24 are preferred.

A grounding slit 26 is also formed along one edge of the outer periphery of the damping frame 8. The grounding slit 26 permits the conducting layer of the membrane of the diaphragm 6 to be electrically connected to the inner surface of the housing 4. The electrical connection may be a wire, solder, conductive adhesive, or other suitable connection means.

The damping frame 8 also includes a damping slit 32 formed along an inner edge of the damping frame 8. FIG. 1 shows one damping slit 32, however, in alternate embodiments, more than one damping slit 32 may be formed along the inner edges of the damping frame 8 if less damping is required. In one embodiment, for example, one damping slit 32 is formed along each inner edge of the damping frame 8 for a total of four damping slits. The dimensions (length, width, height) of the damping slit 32 depend on the how much damping of the peak frequency response curve is desired. In FIG. 1, the damping slit 32 has a width of about 0.5 mm and a depth of about 0.08 mm. The damping frame 8 has a length and width of about 3.22 mm and a thickness of about 0.125 mm. These dimensions are exemplary only, and are not intended to represent the only dimensions contemplated by the present invention. The damping frame 8 may be made of various plastics, such as Teflon, Kapton, and other polyimide materials.

The damping frame 8 shown in FIG. 1 includes backplate clamping members 34 which permit the backplate 10 to be snapped or clamped into place when the backplate 10 is positioned within the damping frame 8. The backplate clamping members 34 are preferably stiffened (for example, made slightly thicker than the thickness of the damping frame 8) to securely hold the backplate 10 within the damping frame 8. In alternate embodiments, in lieu of or in addition to the backplate clamping members 34, adhesive may be used to secure the backplate 10 within the damping frame 8.

Still referring to FIG. 1, the backplate 10 is positioned to oppose the diaphragm 6 within the damping frame 8. The backplate 10 includes standoffs (not shown) on the bottom surface of the backplate 10 to elevate the backplate 10 a distance above the membrane of the diaphragm 6 so as to permit the membrane of the diaphragm 6 to move freely. The dimensions of the backplate 10 are substantially the same as the inner dimensions of the damping frame 8. In a specific embodiment, the backplate 10 a length and width of about 2.44 mm and has a generally square shape.

When the backplate 10 is positioned within the damping frame 8, a damping aperture 36 is formed (shown in FIG. 3). The edges of the damping aperture 36 are defined by the damping frame 8 and the backplate 10. The damping aperture 36 has substantially the same dimensions as the damping slit 32. The damping aperture 36 permits a small amount of air to "escape" from the area between the membrane 23 of the diaphragm 6 and the backplate 10 into the volume of the housing 4 behind the backplate 10. In this respect, the damping aperture 36 increases the inertance of the acoustical sound waves engaging the diaphragm 6, thereby dampening the peak frequency response of the microphone 2. As explained previously, additional damping apertures may be formed between the damping frame 8 and backplate 10 to achieve a frequency response curve according to the demands of a particular application.

The backplate 10 shown in FIG. 1 also includes a production hole 38, which is formed to facilitate handling of the backplate 10 during assembly. When the backplate 10 is positioned in place, the production hole 38 may be plugged with a UV-cured adhesive 44, such as shown in FIG. 2, or other sealant. The backplate 10 includes a non-conductive layer which is made of Kapton, a charged layer which is made of Teflon, and a conductive layer made of Gold. Other suitable materials may be employed instead of Kapton, Teflon, or Gold. In an alternate embodiment, the membrane 23 of the diaphragm 6 is charged, and the backplate includes a metallized layer facing the charged membrane 23 of the diaphragm 6.

The wire 28 connects the conductive layer of the backplate 10 to the circuit board 30. In alternate embodiments, the wire 28 may be a conductive adhesive tape, conductive adhesive, a piece of metal, and the like. The diaphragm 6 and backplate 10 form a plate capacitor whose capacitance changes as the membrane of the diaphragm 6 undulates in response to changes in air pressure caused by acoustical sound waves entering the sound inlet tube 16. These changes in capacitance are detected by the circuit board 30 and are converted to an electrical signal. This electrical signal may be further processed by the circuit board 30. The processing may include any combination of amplification, filtering, shaping, and digitizing, for example. The circuit board 30 may include an integrated A/D converter to provide a digital signal output. The circuit board 30 may include a digital signal processor (DSP) for processing the electrical signal in the wire 28. The circuit board 30 may comprise a monolithic IC, one or more ICs disposed on a substrate or PCB, and/or it may be of a flip-chip design configuration. The pattern shown on the circuit board 30 in FIG. 1 is for illustrative purposes only. The overall output of the microphone 2 is an audio signal corresponding to the acoustical signal received by the sound inlet tube 16.

The microphone 2 shown in FIG. 1 also includes a mounting plate 40 which is dimensioned to fit over the exposed edges of the walls of the housing 4. The circuit board 30 is positioned against the mounting plate 40, and may be secured to the mounting plate 40 by adhesive, solder, or other suitable attachment means. A cover 42 is placed over the circuit board 30 and against the mounting plate 40. In an alternate embodiment, the microphone 2 lacks the mounting plate 40, the cover 42 includes a boss (not shown) around the inner periphery of the cover 42, and the circuit board 30 is positioned against the boss. The mounting plate 40 shown in FIG. 1 may serve as a ground plane for the circuit board 30, and may be made of the same material as the housing 4. It may also provide EMI shielding from the electromagnetic fields generated by the backplate 10 and diaphragm 6.

A cutaway view of an assembled microphone is shown in FIG. 2. In FIG. 2, the backplate 10 can be seen positioned a distance above the diaphragm 6 within the damping frame 8. The damping aperture 36 creates an air pathway between the diaphragm 6 and the rear volume of the housing 4. The production hole 38 in the backplate 10 is plugged with a drop of adhesive 44, such as UV-cured adhesive. Additional adhesive drops 46, 48 secure the backplate 10 within the damping frame 8. The backplate 10, of course, may lack a production hole 38, thereby requiring no drop of adhesive 44.

In an alternate embodiment, the backplate 10 is not secured within the damping frame 8 with adhesive drops 46, 48. In this alternate embodiment, the clamping members 34 securely hold the backplate 10 in position without the further need of adhesive. In yet another embodiment, the production hole 38 may only be partially plugged or not plugged at all, leaving a small damping aperture in the middle of the backplate 10. This small damping aperture may, together with the damping aperture 36, further operate to dampen the peak frequency response of the microphone 2.

In another embodiment, the damping aperture 36 may be defined solely by the damping frame 8. In this embodiment, the damping frame 8 may include a channel that starts from an inner edge of the damping frame 8 facing the membrane 23 and ends on an upper surface of the damping frame 8. Thus, air travels from the surface of the membrane 23 through the channel and into the area behind the backplate 10.

FIG. 3 shows a top view from the rear volume of the microphone 2 looking down on the backplate 10. The cover 42, the circuit board 30, and the mounting plate 40 are not shown in FIG. 3. The damping aperture 36 is defined by an edge portion of the backplate 10 and an edge portion of the damping frame 8. As previously explained, more than one damping aperture 36 may be formed along the other edges of the backplate 10 and the damping frame 8, or the damping aperture 36 may be defined by the backplate 10 only. For example, the production hole 38 may be left open or partially plugged to reveal a damping aperture defined solely by the backplate 10. In yet another embodiment, the backplate 10 includes one or more damping slits formed along one of the edges of the backplate 10 to define a damping aperture. The registration clamping members 24 hold the damping frame 8 in tension against the inner walls of the housing 4.

Figure 4:
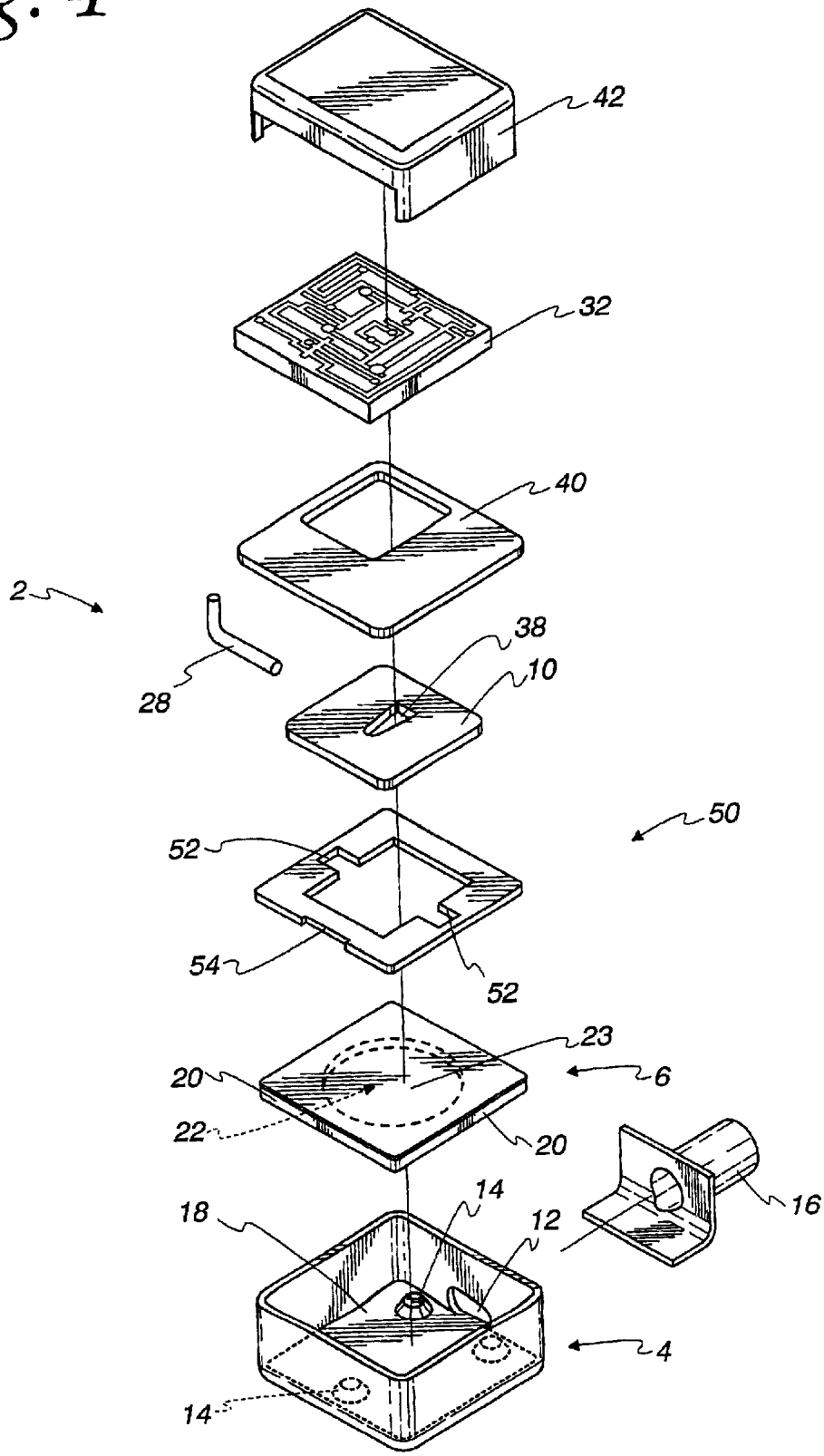
FIG. 4 is an exploded isometric view of a microphone according to one embodiment of the present invention.

FIG. 4 illustrates an exploded isometric view of a microphone 3 including a damping frame 50 which is different from the damping frame 8 shown in FIG. 1. The damping frame 50 shown in FIG. 4 includes two damping slits 52 formed along the inner edges of the damping frame 50, and a grounding slit 54. In a specific aspect of the present invention, the damping slits 52 have length and width dimensions of about 0.5 mm. The damping frame 50 has length and width dimensions of about 3.22 mm and a thickness of about 50 microns. In general, the damping frame 50 is dimensioned to fit within the housing 4. In alternate embodiments, the damping frame 50 may include fewer or more damping slits and the damping slits 52 may have different dimensions depending upon the particular design requirements of an application.

Figure 5:
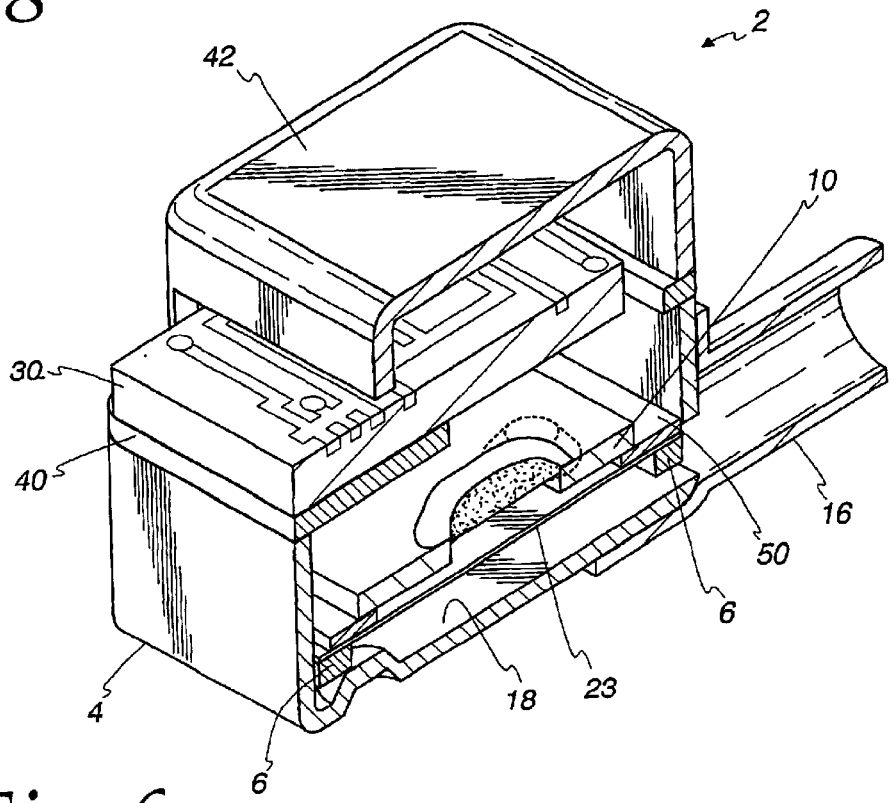
FIG. 5 is a cross-sectional isometric view of the microphone illustrated in FIG. 4.

FIG. 5 illustrates the backplate 10 positioned against the damping frame 50, wherein the damping frame 50 maintains the backplate 10 a predetermined distance away from the membrane of the diaphragm 6. This predetermined distance is defined by the thickness of the damping frame 50. The damping frame 50 thus acts like a spacer, allowing movement of the membrane of the diaphragm 6. The backplate 10 is secured to the damping frame 50 with an adhesive. The damping frame 50 is also secured to the diaphragm 6 with an adhesive.

Figure 6:
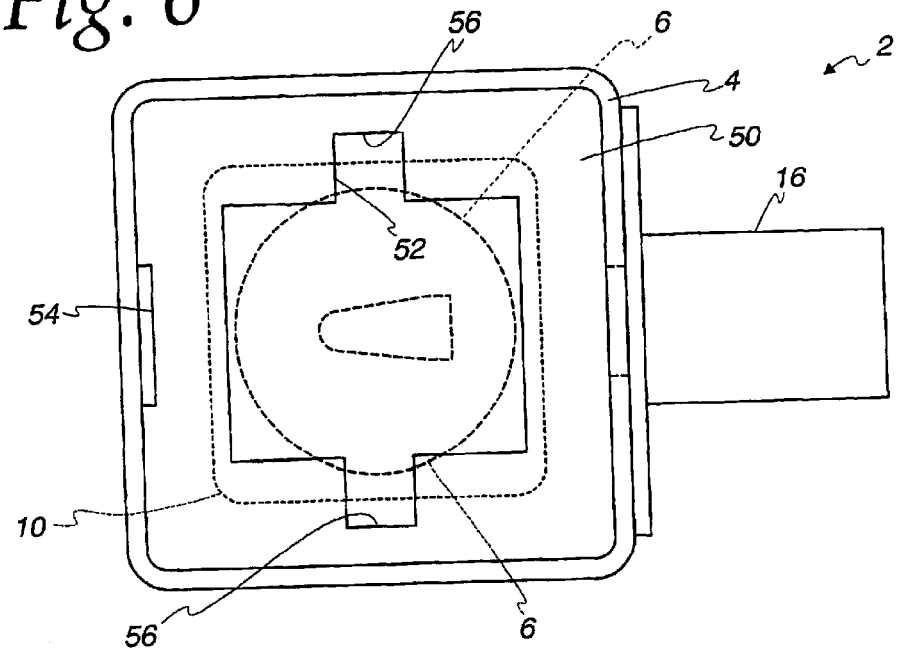
FIG. 6 is a top view that illustrates the inter-relationship of the cartridge of the microphone illustrated in FIG. 4.

FIG. 6 illustrates a top perspective view of the diaphragm 6, damping frame 50, and backplate 10 of the microphone 3. The positioning of the backplate 10 against the damping frame 50 defines two damping apertures 56. These damping apertures 56 form pathways for air to "escape" from the area between the backplate 10 and the membrane of the diaphragm 6 into the air volume in the microphone 3 behind the backplate 8. These pathways increase the inertance to the acoustical sound waves entering the sound inlet 16.

The damping apertures 56 shown in FIG. 6 also allow for imperfect centering of the backplate 10. Thus, regardless of how the backplate 10 is positioned over the damping frame 50, the combined area of the damping apertures 56 remains the same. For example, if the backplate 10 covers one damping slit 52 more than the other, the mostly exposed damping slit 52 will define a larger damping aperture 56, whereas the mostly covered damping slit 52 will define a proportionally smaller damping aperture 56. The combined area of the larger damping aperture 56 and the smaller damping aperture 56 equals the combined area of equally sized damping apertures 56. Thus, production of the microphone 3 can be greatly simplified without an undesirable variance in performance from one microphone to another.

As explained in connection with FIGS. 1–3, in alternate embodiments, the damping aperture 56 may be defined solely by the backplate 10 or solely by the damping frame 50. For example, the backplate 10 may include an aperture through which air may travel from the surface of the membrane 23 to the area behind the backplate 10. The damping frame 50 may include a channel which defines a pathway from the surface of the membrane 23 to the area behind the backplate 10.

In an alternate embodiment, the thickness of the damping frame 50 may be decreased to achieve squeezed film damping. This squeezed film damping is in addition to the damping caused by the damping frame 50. In this embodiment, the thickness of the damping frame 50 is reduced to about 37.5 microns or smaller. As is known, the amount of damping is inversely proportional to the third power of the distance between the backplate 10 and the diaphragm 6. For some applications, this reduction in dampening effect may be acceptable. For other applications that require more dampening of the peak frequency response, the dimensions of the damping slits 52 may be reduced.

Figure 7:
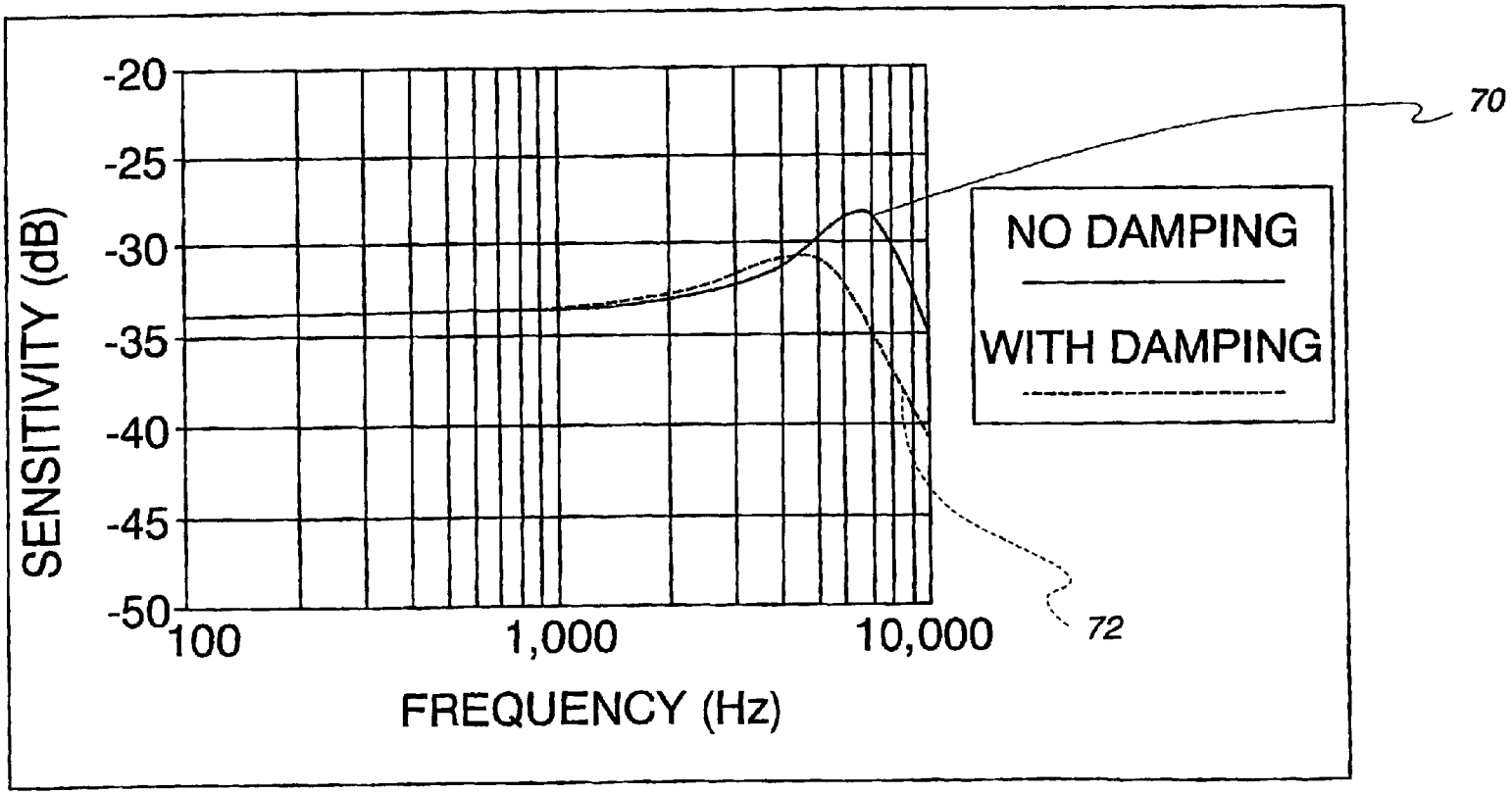
FIG. 7 is a chart illustrating a frequency response curve of a microphone that includes a damping mechanism according to the present invention and a frequency response curve of a microphone that lacks a damping mechanism.

FIG. 7 illustrates two exemplary curves comparing the frequency response curves of a microphone that lacks a damping mechanism and a microphone such as shown in FIG. 2 or FIG. 5 that includes a damping mechanism. Curve 70 drawn according to a logarithmic audio-frequency scale represents an exemplary frequency response curve of a microphone that lacks a damping mechanism. Curve 72 represents an exemplary frequency response curve of a microphone such as the microphone 2 shown in FIG. 2 or FIG. 5. Curve 72 illustrates that the frequency response of the microphone is reduced compared to that of curve 70 at a range of about 2 kHz to about 10 kHz.

Figure 8:
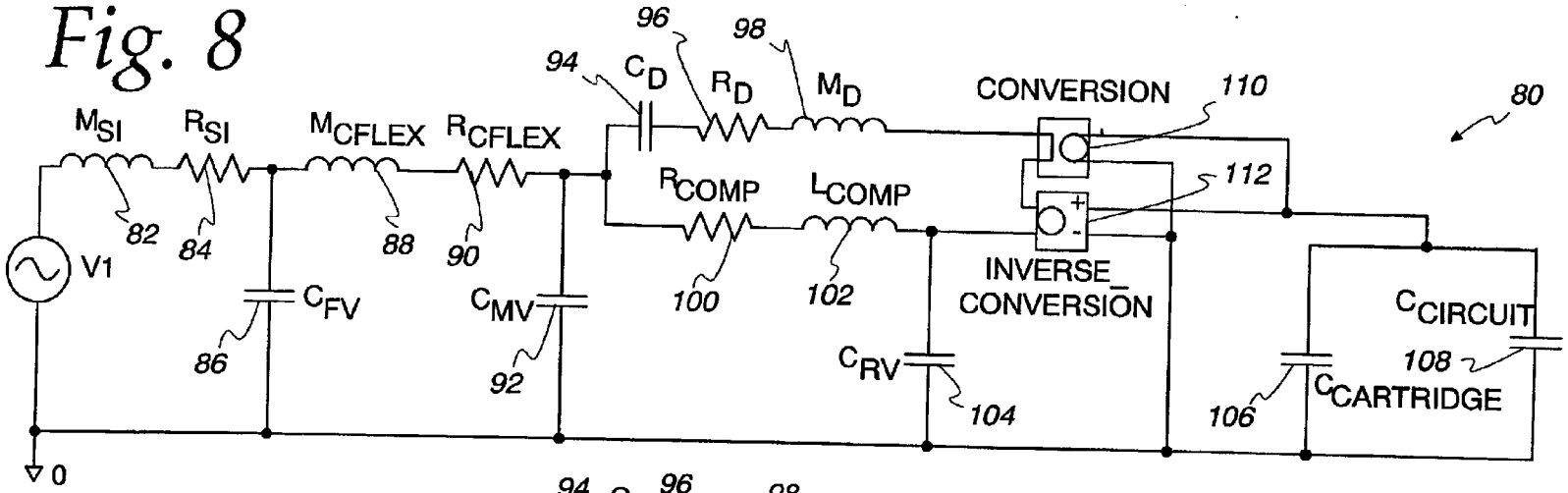
FIG. 8 is a functional circuit diagram of an electrical representation of an acoustical network according to a microphone having a damping mechanism in the front volume of the microphone.
Figure 9:
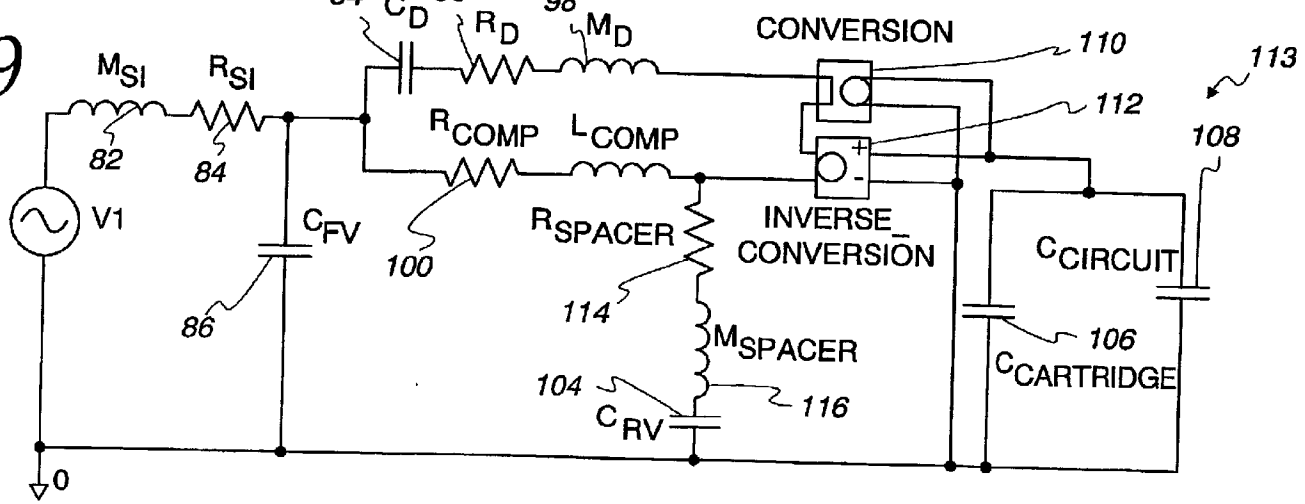
FIG. 9 is a functional circuit diagram of an electrical representation of an acoustical network according to a microphone of the present invention having a damping mechanism in the rear volume of the microphone.

FIGS. 8 and 9 illustrate respective circuit diagrams of an electrical representation of (1) an acoustical network 80 having a front-volume damping mechanism and (2) an acoustical network 113 having a rear-volume damping mechanism according to the present invention. The acoustical network 80 of FIG. 8 illustrates the electrical equivalents of the acoustical elements of a microphone having a front-volume damping mechanism. $M_{si}$ 80 and $R_{si}$ 82 represent the inertance and acoustical resistance of the sound inlet, respectively. $C_{fv}$ 86 is the capacitance of the front volume of the microphone 80. The damping mechanism, which is located in the front volume, is represented as $M_{cflex}$ 88 and $R_{cflex}$ 90 which correspond to the mass and resistance of the front-volume damping structure. $C_{mv}$ 92 is the capacitance of a middle volume created by the front-volume damping structure with c-flex material. Next, the compliance, resistance, and mass of the diaphragm are represented by $C_d$ 94, $R_d$ 96, and $M_d$ 98, respectively. The compensation elements of the membrane of the diaphragm, such as the pressure vent, are represented as $R_{comp}$ 100 and $L_{comp}$ 102, respectively. The capacitances of the rear volume, $C_{rv}$ 104, the cartridge assembly which includes the diaphragm and backplate, $C_{cartidge}$ 106, and the electronic circuit, $C_{circuit}$ 108, are indicated in their electrical equivalent form. The conversion 110 and inverse_conversion 112 represents the transduction of sound energy into an electrical signal, and the conversion of an electrical signal into an acoustical signal, respectively. The effect of the inverse_conversion 112 is small compared to the effect of the conversion 110 due to the low electrical currents involved.

Turning now to FIG. 9, there is shown an electrical representation of the acoustical network 113 of a microphone, such as the microphone 2 shown in FIGS. 1–3 or 4–6, having a damping mechanism in the rear volume. The circuit diagram of FIG. 9 depicts the presence of a damping mechanism, such as the damping frame 8 or the damping frame 50 shown in FIGS. 1 and 4, respectively, in the rear volume of the microphone. The resistance and mass of the damping mechanism is represented in the circuit diagram as $R_{spacer}$ 114 and $M_{spacer}$ 116.

Figure 10:
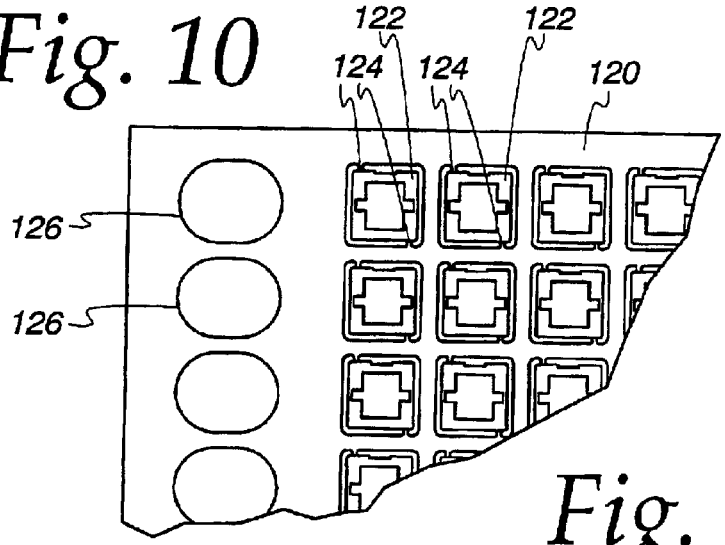
FIG. 10 illustrates a portion of a production sheet including a plurality of damping frames such as the damping frame illustrated in FIG. 4.
Figure 11:
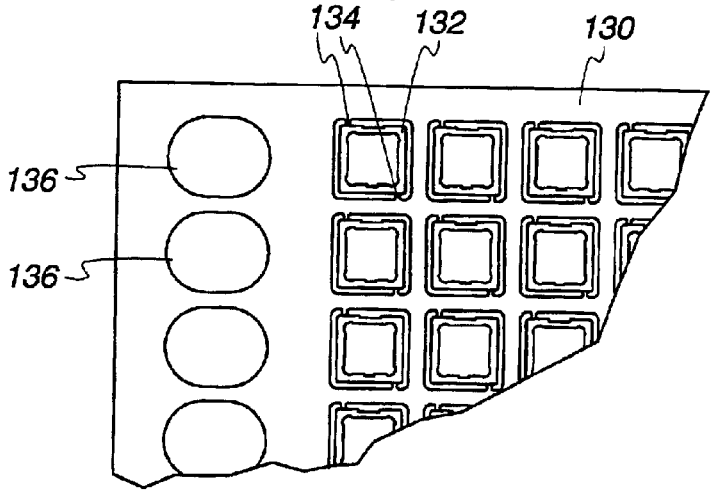
FIG. 11 illustrates a portion of another production sheet including a plurality of damping frames such as the damping frame illustrated in FIG. 1.
Figure 12:
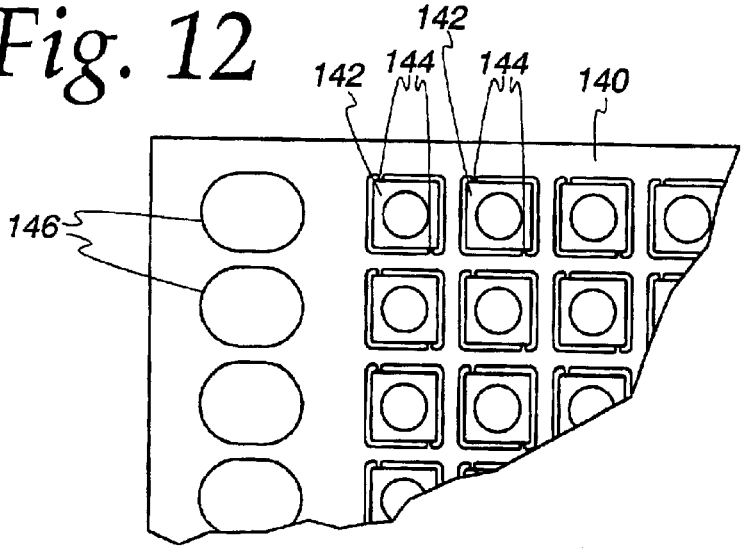
FIG. 12 illustrates a portion of a production sheet including a plurality of diaphragms.

FIGS. 10–12 illustrate portions of production sheets which are used to form a plurality of cartridges for use in a microphone. FIG. 10 shows a portion of a production sheet 120 containing a plurality of damping frames 122, like the damping frame 50 shown in FIG. 4. FIG. 11 also shows a portion of a production sheet 130 containing a plurality of damping frames 132, like the damping frame 8 shown in FIG. 1. Breakaway bridges 124, 134 are formed to secure the damping frames 122, 132 to the production sheet 120, 130, respectively. These breakaway bridges 124, 134 are broken after the damping frames 122, 132 have been stamped out of the production sheets 120, 130. In a specific embodiment, the production sheets 120, 130 include a matrix of 15×15 damping frames 122, 132 for a total of 225 damping frames 122, 132. Each individual damping frame 122, 132, including the damping slits 52, 32, is formed using a laser, for example. The production sheets 120, 130 are made of Kapton, but in alternate embodiments, they may be made of any other suitable polyimide material, such as Teflon or plastic, for example.

The production sheets 120, 130 also include a plurality of registration holes 126, 136 disposed along an unused portion of the production sheets 120, 130. The registration holes 126, 136 are used during production to align one sheet over another, as explained in connection with FIGS. 13 and 14. In a specific embodiment, the centers of the registrations holes 126, 136 are spaced about 5.5 mm apart. The centers of each damping frame 122, 132 are spaced about 4.72 mm apart. The thickness of the production sheets 120, 130 is about 125 microns (plus or minus 10 microns). These dimensions vary in alternate embodiments depending on the size of the microphone under production.

FIG. 12 shows a portion of a production sheet 140 containing a plurality of diaphragms 142, like the diaphragm 6 shown in FIG. 1. Each diaphragm 142 is held onto the production sheet 140 by breakaway bridges 144, which, once broken, free the diaphragms 142 from the production sheet 140. The production sheet 140 also includes a plurality of registration holes 146 disposed along an unused portion of the production sheet 140. In a specific embodiment, the production sheet 140 is made of a copper/zinc alloy, and has a thickness of about 0.15 mm. One surface of the production sheet 140 includes a thin layer of tin, approximately two to five microns thick. On the opposing surface, mylar is evaporated with gold to form the membrane of each diaphragm 142. The mylar surface is positioned against a damping frame, as discussed next.

Figure 13:
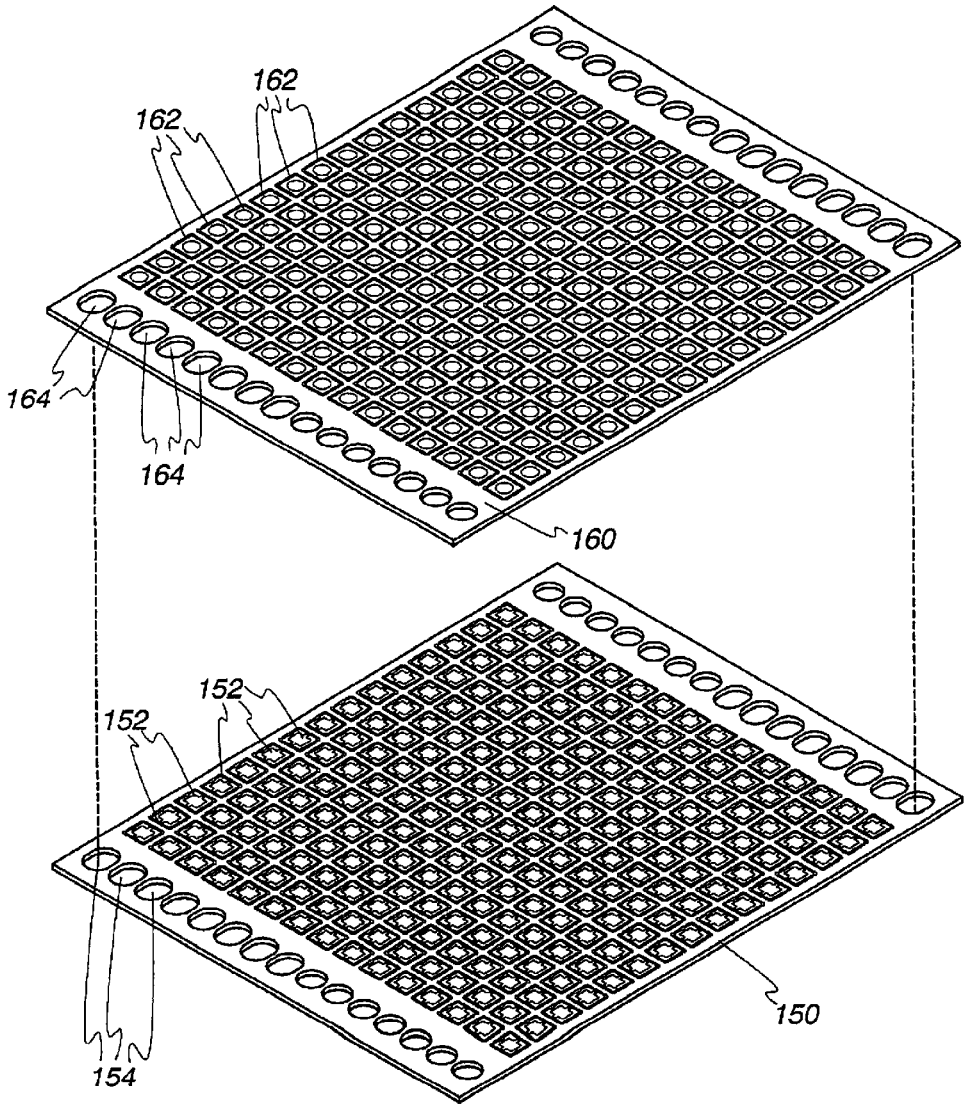
FIG. 13 illustrates an intermediate production step of assembling a carrier sheet that includes a production sheet containing diaphragms and a production sheet containing damping frames.
Figure 14:
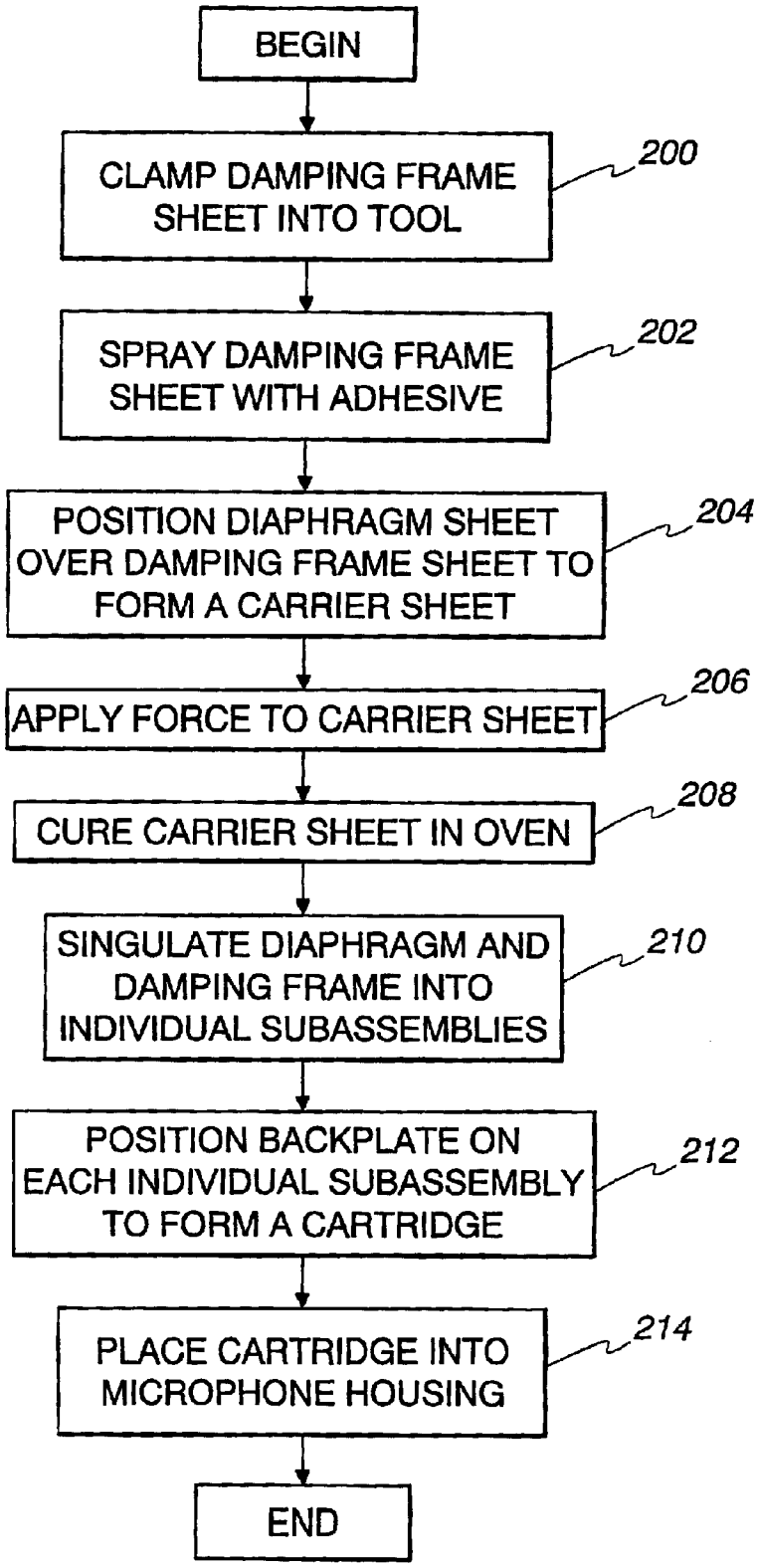
FIG. 14 is a flowchart of the steps to produce a cartridge for use in a microphone according to one aspect of the present invention.

The assembly of a cartridge for use in a microphone according to the present invention will be discussed with reference to FIGS. 13 and 14. A production sheet 150 containing a plurality of damping frames 152 is clamped into a tool (not shown) along the registration holes 154 of the production sheet 150 (step 200). The tool (not shown) may include pins which are dimensioned to fit into one or more of the registration holes 154 of the production sheet 150. At step 202, the exposed surface of the production sheet 150 is sprayed with an adhesive. A production sheet 160 containing a plurality of diaphragms 162 and registration holes 164 is positioned against the production sheet 150 to form a carrier sheet (step 204), such that a portion of the membrane surface of the diaphragms 162 contacts the exposed surfaces of the damping frames 152. The registration holes 164 of the production sheet 160 are aligned with the registration holes 154 of the production sheet 150, such as shown in FIG. 13. The optional pins of the tool (not shown) may be used to align the registration holes 154, 164. Note that the registration holes 154, 164 have varying dimensions along the surface of the production sheets 150, 160, respectively. The varied dimensions (i.e., circular and elliptical) ensure that the proper surfaces of the production sheets 150, 160 are positioned against one another.

A force is applied to the carrier sheet at step 206 to ensure contact of the diaphragms 162 with the damping frames 152. At step 208, the carrier sheet is cured in an oven, for example, until the adhesive spray sets. The duration and temperature are determined by the curing characteristics of the adhesive.

At step 210, a machine or tool is employed to singulate each diaphragm 162 and damping frame 152 disposed on the production sheets 160, 150, respectively, into individual subassemblies containing a diaphragm adhered to a damping frame. At step 212, a backplate is positioned against each individual subassembly to form a cartridge. The production hole, such as the production hole 38 shown in FIG. 1, of the backplate may be used to position the backplate onto an individual subassembly. As mentioned previously, this production hole may be plugged with a drop of adhesive, such as the adhesive drop 44 shown in FIG. 2.

In one embodiment, the production sheet 150 includes a plurality of damping frames 152 such as the damping frame 8 shown in FIG. 1. In this embodiment, each backplate is clamped into the damping frame of the individual subassembly and is held in place by the backplate clamping members 34. Adhesive may be optionally applied to form a secure bond between the backplate and damping frame.

In another embodiment, the production sheet 150 includes a plurality of damping frames 152 such as the damping frame 50 shown in FIG. 4. In this embodiment, each backplate is secured to the damping frame of the individual subassembly by a layer or drops of adhesive disposed between the backplate and the damping frame of the individual subassembly. As mentioned previously, it is not necessary for the backplate to be centered precisely over the damping frame to achieve the desired dampening of the frequency response curve.

At step 214, the cartridge is placed into a microphone housing 4. If the microphone housing 4 includes embossments 14, the cartridge may be secured to the embossments 14 by an adhesive. Alternatively, if the damping frame includes registration members 24, the registration members 24 may secure the cartridge in tension against the walls of the microphone housing 4 to create a tight fit.

As noted in connection with FIG. 1, the diaphragm 6 includes a shaped opening that may take any shape. In the illustrated embodiments, the shaped opening has a generally circular shape. It is understood that a diaphragm according to any embodiment of the present invention may include any opening having an appropriate shape, such as generally square or generally polygonal. The shape of the opening may depend upon the particular geometry of the damping frame disposed above the diaphragm.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A microphone comprising:

a diaphragm;

a backplate opposing said diaphragm;

a spacer element positioned adjacent said diaphragm;

a housing having first, second, and third interacting sound chambers, said first sound chamber being substantially defined by walls of said housing and said diaphragm, said second sound chamber being substantially defined by said diaphragm, said backplate, and said spacer element, said third sound chamber being substantially defined by said backplate and walls of said housing; and at least one aperture having a distal end and a proximate end, said distal end of said aperture being adjacent said second sound chamber and bounded at least partially by said backplate, said proximate end being adjacent said third sound chamber and bounded at least partially by a structure other than said backplate, said aperture connecting said second and third sound chambers and having selected dimensional characteristics for dampening a frequency response curve for said microphone.

2. The microphone of claim 1, wherein the relative size of said sound chambers in increasing order from smallest to largest is said second sound chamber, said first sound chamber, and said third sound chamber.

3. The microphone of 1, wherein said at least one aperture is exactly one aperture.

4. The microphone of 1, wherein said at least one aperture is exactly two apertures.

5. The microphone of 1, wherein said at least one aperture is at least two apertures.

6. The microphone of 1, wherein said at least one aperture is exactly four apertures.

7. The microphone of 1, wherein said at least one aperture has a length of about 0.5 mm and a width of about 0.5 mm.

8. The microphone of claim 7, wherein said at least one aperture has a thickness of at least about 50 microns.

9. The microphone of claim 7, wherein said at least one aperture has a thickness of less than about 37.5 microns.

10. The microphone of claim 1, wherein said dampening reduces said frequency response curve at a range of about 2 kHz to about 10 kHz.

11. The microphone of claim 1, wherein said housing includes a floor, said diaphragm including a membrane frame and a membrane disposed across a surface of said membrane frame, said membrane frame contacting said floor.

12. The microphone of claim 1, wherein said spacer element has an outer perimeter, said spacer element having a clamping member formed along said outer perimeter and contacting an inner portion of said housing, said clamping member holding said spacer element in a fixed position within said housing.

13. The microphone of claim 12, wherein said spacer element includes an opening, said opening being dimensioned to hold said backplate within said opening.

14. The microphone of claim 13, wherein said backplate includes a bottom surface opposing said diaphragm, said bottom surface having at least one standoff disposed thereon, said at least one standoff contacting said diaphragm.

15. The microphone of claim 1, wherein said housing includes a bottom surface having at least one support member, said diaphragm being mounted on said at least one support member.

16. The microphone of claim 15, wherein said support member is an embossment formed by deforming said housing to create a protrusion extending into said inner volume of said housing.

17. The microphone of claim 15, wherein the bottom surface of said housing includes at least three support members.

18. The microphone of claim 1, wherein said diaphragm includes a pressure vent for equalizing pressure between said first sound chamber and said second sound chamber.

19. The microphone of claim 1, wherein said spacer element is made of a polyimide material.

20. The microphone of claim 1, wherein said spacer element is made of Kapton.

21. The microphone of claim 1, wherein said backplate has a charged surface opposing said diaphragm.

22. The microphone of claim 21, wherein said charged surface is Teflon.

23. The microphone of claim 1, wherein the thickness of said spacer element is at least about 125 microns.

24. The microphone of claim 1, wherein the thickness of said spacer element is at least about 50 microns.

25. The microphone of claim 1, wherein the thickness of said spacer element is less than about 37.5 microns.

26. The microphone of claim 1, wherein said first sound chamber lacks structure for dampening the frequency response curve of said microphone.

27. The microphone of claim 1, wherein said structure is said spacer element.

28. The microphone of claim 1, wherein said aperture is partially plugged by said structure.

29. The microphone of claim 28, wherein said structure is an adhesive.

30. The microphone of claim 29, wherein said adhesive is UV-cured.

31. A method for dampening the frequency response curve of a microphone, comprising:

positioning a spacer element adjacent a diaphragm; and providing a backplate opposing said diaphragm and a housing having first, second, and third interacting sound chambers, said first sound chamber being substantially defined by walls of said housing and said diaphragm, said second sound chamber being substantially defined between said diaphragm and said backplate, and said spacer element; said third sound chamber being substantially defined by said backplate and walls of said housing, wherein the step of providing forms at least one aperture having a distal end and a proximate end, said distal end of said aperture being adjacent said second sound chamber and bounded at least partially by said backplate, said proximate end being adjacent said third sound chamber and bounded at least partially by a structure other than said backplate, said aperture connecting said second and third sound chambers and having selected dimensional characteristics for dampening a frequency response curve for said microphone.

* * * * *